US005456289A

United States Patent [19]

Bergmann

[11] Patent Number: 5,456,289

[45] Date of Patent: Oct. 10, 1995

[54] PLUMBING FIXTURE WITH PASSAGE CHOKE HAVING A KNOCKOUT

[75] Inventor: Konrad Bergmann, Wittlich, Germany

[73] Assignee: Ideal-Standard GmbH, Bonn, Germany

[21] Appl. No.: 119,097

[22] PCT Filed: Mar. 10, 1992

[86] PCT No.: PCT/EP92/00538

§ 371 Date: Oct. 7, 1993

§ 102(e) Date: Oct. 7, 1993

[87] PCT Pub. No.: WO92/16698

PCT Pub. Date: Oct. 1, 1992

[30] Foreign Application Priority Data

Mar. 14, 1991 [AT] Austria ..... 581/91

[51] Int. Cl.[6] ..... F16L 1/14; B05B 1/26

[52] U.S. Cl. ..... 138/45; 138/40; 138/44; 138/46; 137/67; 239/596

[58] Field of Search ..... 138/40, 44, 46, 138/45, 89; 137/68.1, 68; 239/533.1, 533.13, 533.14, 546, 589, 597, 600, 601, 596

[56] References Cited

U.S. PATENT DOCUMENTS

| | | | |
|---|---|---|---|
| 2,633,343 | 3/1953 | Aghinides . | |
| 2,661,753 | 12/1953 | Stroop | 137/68.1 |
| 2,744,738 | 5/1956 | Hjulian . | |
| 2,889,999 | 6/1959 | Tomlinson . | |
| 3,123,517 | 3/1964 | Davis | 137/68.1 |
| 3,362,742 | 1/1968 | Sanderson | 137/68.1 |
| 3,566,902 | 3/1971 | Muller | 138/45 |
| 3,635,405 | 1/1972 | Shames . | |
| 3,654,965 | 4/1972 | Gramain | 138/89 |
| 4,202,501 | 5/1980 | Haynes . | |
| 4,294,289 | 10/1981 | Fischer . | |
| 4,313,471 | 2/1982 | Lissau | 138/45 |
| 4,346,848 | 8/1982 | Malcolm . | |
| 4,830,057 | 5/1989 | Hendrickson | 138/45 |
| 4,978,947 | 12/1990 | Finnegan | 137/68.1 |
| 4,986,312 | 1/1991 | Gute | 138/45 |
| 5,158,114 | 10/1992 | Botsolas | 138/110 |

FOREIGN PATENT DOCUMENTS

| | | |
|---|---|---|
| 46743 | 3/1982 | European Pat. Off. . |
| 380042 | 8/1964 | Switzerland . |

*Primary Examiner*—James E. Bryant, III
*Attorney, Agent, or Firm*—Herbert Dubno; Andrew Wilford

[57] ABSTRACT

A passage choke in particular for the outlet of a plumbing fixture which is installed between the end (9) of the outlet (5) and an aerator (6) or a flow controller, which is provided with a through-flow opening (8) which advantageously has to enlarge it a knockout (12).

5 Claims, 2 Drawing Sheets

PLUMBING FIXTURE WITH PASSAGE CHOKE HAVING A KNOCKOUT

This application is a national application of the international application PCT/EP92/00538 filed 10 Mar. 1992 designating the United States.

FIELD OF THE INVENTION

The invention relates to a device for limiting flow in particular for the outlet of a plumbing fixture. Water is ever more expensive. This is due to increasing waste and pollution so that it is necessary for communities to build ever more purification plants. Water conservation is thus indicated. Notwithstanding changes in individual behavior, water use as regards plumbing setups can be reduced, e.g. by additional valves which serve as passage chokes and restrict flow and that are easily installed on the outlet. Also known are specially designed aerators incorporating passage chokes.

The state of the art, e.g. U.S. Pat. No. 4,202,501 describes a constant-flow maintainer whose through-flow opening or openings get smaller with increasing water pressure or get bigger with decreasing water pressure and in this manner maintain flow constant.

A disadvantage of these known systems is that the additional valves are relatively expensive items.

OBJECT OF THE INVENTION

It is an object of the invention to avoid this disadvantage and to provide a device for limiting flow of the abovenamed type which is very simple to make, inexpensive to manufacture, sure in function, and very easy to install as a retrofit.

SUMMARY OF THE INVENTION

This object is attained preferably mainly by the positioning and thus of the installation of the passage choke between the end of the outlet of the plumbing fixture and an aerator or a flow controller. Preferably the passage choke is formed unitarily as one piece with a through-flow opening. Further embodiments of the invention are described in the dependent claims.

SPECIFIC DESCRIPTION

Figure 1:
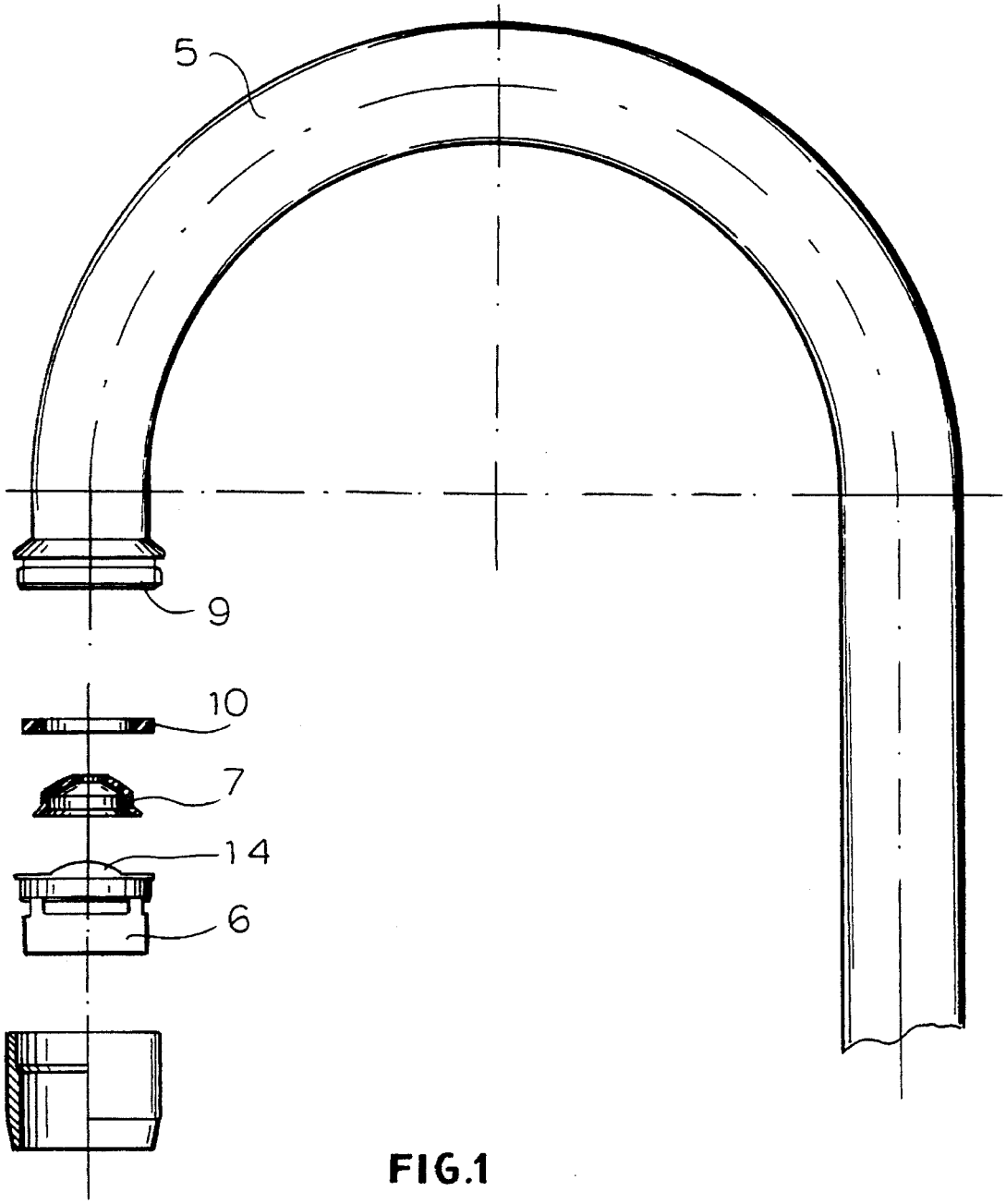
FIG. 1 an exploded view of a pivotal pipe outlet of a laundry fixture with an aerator, a seal ring, and a passage choke according to the invention.

FIG. 1 shows at 5 the pipe outlet and at 6 the aerator. The passage choke 7 is comprised of a one-piece synthetic-resin part which has a central through-flow opening 8 and which is surrounded by a seal ring 10 provided between the end 9 of the pipe outlet 5 and the aerator 6. The passage choke has external ridges 11 for a tight fit with the seal ring 10 in premounted condition.

Figure 4:
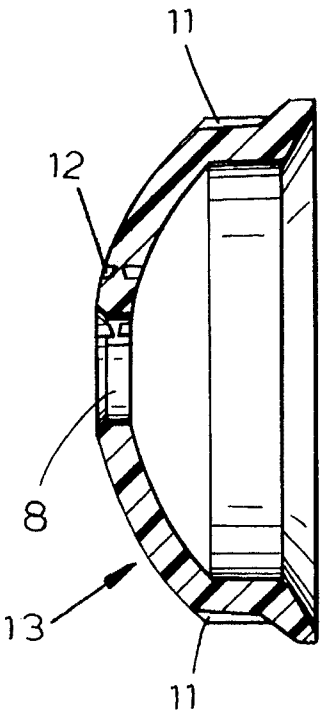
FIG. 4 a section through the passage choke.
Figure 3:
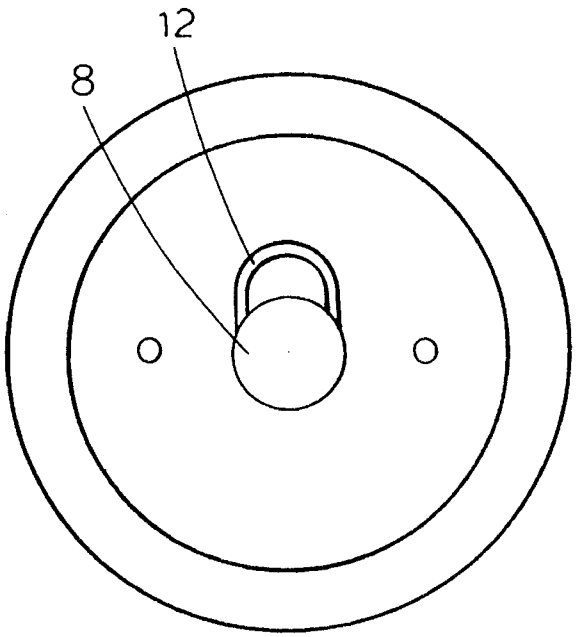
FIG. 3 a bottom view of the passage choke.
Figure 2:
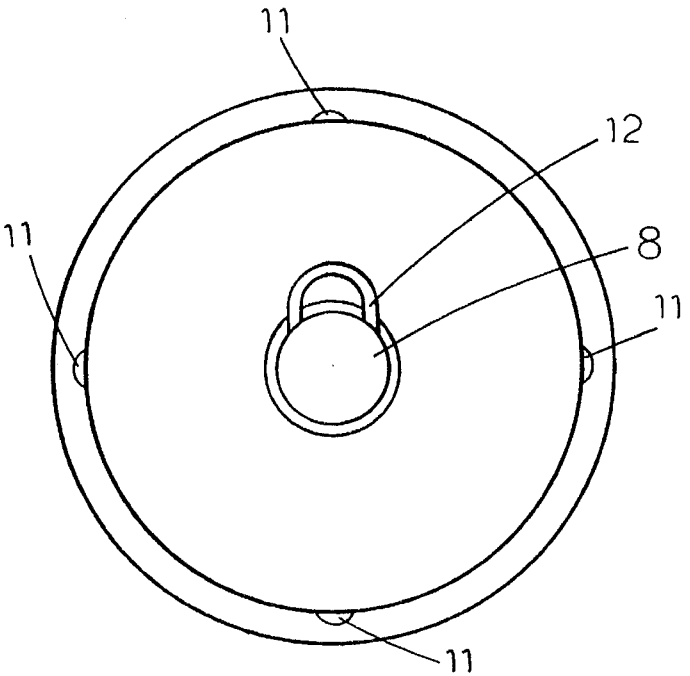
FIG. 2 a top view of the passage choke.

As further visible in FIGS. 2–4, the passage choke 7 has a knockout 12 for optional. enlargement of the through-flow opening 8. In this manner through-flow at 3bar can be 7.5 liters/min 9 liter/min. Without the passage choke through-flow is 12 l/min. For reasons of stability and to reduce the wall thickness as well as the cost, the passage choke 7 has a curve 13 against the flow direction. The first screen of the aerator 6 has a corresponding curve so that the passage choke 7 extends in its curved region 13 parallel or generally parallel and spaced from the known first screen 14 of the aerator 6 which is curved against the flow direction. Preferably this spacing is between 1 and 3 mm.

In installed condition there is between the curved region of the passage choke and the screen 14 a space of about 2 mm. This produces a relatively large space between the choke 7 which can for example hold particles without flow through it being significantly affected. In connection with this relatively large through-flow opening, whose clear diameter without removal of the knockout is 3.2 mm, blockages are not possible.

As already described, the illustrated and described embodiment is only one example of an embodiment of the invention and same is not restricted to it. Rather, in the scope of the basic idea of the invention there are other applications and embodiments. Thus the passage choke can be formed of a piece of an elastomeric synthetic resin with the seal ring 10 eliminated. In this embodiment the passage choke has with differential pressures the function of a constant-flow maintainer to a limited extent. Finally the passage choke can for example also be provided between the end of the outlet and a hose or between same and a spray head.

What is claimed is:

1. In combination with a plumbing fixture having an outlet from which liquid flows in a flow direction, a passage choke fitted to the outlet and formed unitarily as one piece with a central through-flow opening having a first operable flow cross section, and a knockout adjacent the opening removable to enlarge the opening, a means to remove the knockout and enlarge said central throughflow opening to a larger opening having a second operable flow cross section, the choke being convexly curved toward the outlet.

2. The passage choke defined in claim 1, further comprising a seal ring surrounding the passage choke.

3. The passage choke defined in claim 2 wherein the passage choke is externally formed with ridges engaging the seal ring.

4. The passage choke defined in claim 1 wherein the passage choke is made of a synthetic resin.

5. The passage choke defined in claim 4 wherein the resin synthetic is elastomeric.

* * * * *